US012357141B2

(12) United States Patent
Hanslmeier et al.

(10) Patent No.: US 12,357,141 B2
(45) Date of Patent: Jul. 15, 2025

(54) METHOD FOR CONTROLLING A CLEARING PROCESS IN A VACUUM CLEANING DEVICE, AND VACUUM CLEANING DEVICE

(71) Applicant: Hilti Aktiengesellschaft, Schaan (LI)

(72) Inventors: Xaver Hanslmeier, Mauerstetten (DE); Svenja Müller, Friedberg (DE); Rainer Stahl, Stuttgart (DE); Dominik Wenning, Besigheim (DE)

(73) Assignee: Hilti Aktiengesellschaft, Schaan (LI)

( * ) Notice: Subject to any disclaimer, the term of this patent is extended or adjusted under 35 U.S.C. 154(b) by 683 days.

(21) Appl. No.: 17/442,851

(22) PCT Filed: Apr. 9, 2020

(86) PCT No.: PCT/EP2020/060122
§ 371 (c)(1),
(2) Date: Sep. 24, 2021

(87) PCT Pub. No.: WO2020/216628
PCT Pub. Date: Oct. 29, 2020

(65) Prior Publication Data

US 2022/0183523 A1 Jun. 16, 2022

(30) Foreign Application Priority Data

Apr. 23, 2019 (EP) ..... 19170577

(51) Int. Cl.
*A47L 9/19* (2006.01)
*A47L 9/20* (2006.01)
*A47L 9/28* (2006.01)

(52) U.S. Cl.
CPC ..... *A47L 9/19* (2013.01); *A47L 9/20* (2013.01); *A47L 9/2821* (2013.01)

(58) Field of Classification Search
CPC . A47L 9/19; A47L 9/20; A47L 9/2821; B01D 46/446; B01D 46/04
See application file for complete search history.

(56) References Cited

U.S. PATENT DOCUMENTS 7,867,304 B2 1/2011 Stewen et al.
2005/0065662 A1* 3/2005 Reindle ..... A47L 9/2821 701/1

(Continued)

FOREIGN PATENT DOCUMENTS

CN 101801252 A 8/2010
CN 106102536 A 11/2016

(Continued)

OTHER PUBLICATIONS

International Search Report of PCT/EP2020/060122 of Jun. 18, 2020.

*Primary Examiner* — Douglas Lee
(74) *Attorney, Agent, or Firm* — Davidson Kappel LLC

(57) ABSTRACT

A method for controlling a clearing process in a vacuum cleaning device, wherein the vacuum cleaning device comprises at least one filter, which is cleared regularly. The method proposed allows, in particular, differential-pressure-dependent filter clearing in accordance with requirements, during which filter aging and/or filter wear can also be taken into account. In a second aspect, the invention relates to a vacuum cleaning device by means of which the proposed control method can be carried out. For this purpose, the vacuum cleaning device can comprise, in particular, a filter clearing unit.

11 Claims, 2 Drawing Sheets

(56) References Cited

U.S. PATENT DOCUMENTS

| | | | | |
|---|---|---|---|---|
| 2008/0092498 | A1 | 4/2008 | Stewen et al. | |
| 2010/0293743 | A1 | 11/2010 | Beskow et al. | |
| 2015/0343348 | A1 | 12/2015 | Morris et al. | |
| 2017/0001136 | A1 * | 1/2017 | Hensel | A47L 9/20 |
| 2023/0114976 | A1 | 4/2023 | Hanslmeier | |

FOREIGN PATENT DOCUMENTS

| | | | | |
|---|---|---|---|---|
| CN | 106413842 | A | 2/2017 | |
| DE | 102005017702 | A1 | 10/2006 | |
| DE | 102008038893 | A1 | 2/2010 | |
| DE | 202012003280 | U1 | 4/2012 | |
| EP | 2153768 | A2 | 2/2010 | |
| EP | 2301404 | A2 * | 3/2011 | A47L 9/19 |
| EP | 2457485 | A1 | 5/2012 | |
| EP | 2644076 | A1 | 10/2013 | |
| JP | 2007245019 | A | 9/2007 | |

* cited by examiner

METHOD FOR CONTROLLING A CLEARING PROCESS IN A VACUUM CLEANING DEVICE, AND VACUUM CLEANING DEVICE

BACKGROUND

The present invention relates to a method for controlling a clearing process in a vacuum cleaning device, wherein the vacuum cleaning device comprises at least one filter, which is cleared regularly.

The prior art includes vacuum cleaning devices which are used, in particular, on construction sites in order to remove dust that is formed in connection with the use of power tools, e.g. drills or grinders. Such "construction site vacuum cleaners" generally comprise a vacuum cleaner head in an upper region and a collecting container for the collected dust in a lower region of the vacuum cleaning device. According to the invention, such vacuum cleaners are preferably also referred to as industrial vacuum cleaners, construction site vacuum cleaners or construction-grade vacuum cleaners.

In the case of known construction-grade vacuum cleaners, the dust is sucked in by means of a turbine, which is driven by means of a motor. In particular, the turbine produces an extraction flow by providing a vacuum in the vacuum cleaning device. As a preferred possibility, the turbine can also be designed as a blower. The turbine or blower is a sensitive component of the vacuum cleaning device, which must be protected especially from dust. Filters or filter elements are therefore usually arranged upstream of the blower or turbine in order to filter any dust remaining in the extraction flow out of the extraction flow before the dust enters the region of the turbine or blower. These filters or filter elements may become clogged with dust over time, and this may impair their functionality.

Conventional construction-site vacuum cleaners that are known from the prior art generally have a filter clearing unit by means of which the filter of the vacuum cleaning device can be cleaned at regular intervals. As used herein, such filter cleaning is preferably referred to as "filter clearing". In general, the vacuum in the vacuum cleaning device is reduced in the filter clearing process, thereby briefly interrupting the sucking in of the dust and cleaning the filter. In some devices, provision is made to flush the filter elements with a countercurrent and thus release any filter cake that may be present. The filter cleaning process is generally controlled on a time basis. It is possible, for example, to store or define in the vacuum cleaning device or a control unit of the vacuum cleaning device regularly recurring time intervals at which filter clearing is carried out automatically. In such time-based filter clearing processes, clearing cycles are carried out at regular time intervals. The quality of clearing can be described or documented using a clearing grade.

SUMMARY OF THE INVENTION

However, the disadvantage with the filter clearing methods known from the prior art is that filter wear or filter aging is not taken into account in the control or initiation of the filter clearing process, and therefore a significant factor in the achievement of a high clearing quality is not included in the control of clearing. As a result, it may happen that clearing does not take place at suitable times or that it is carried out either too early and thus too frequently or too infrequently and therefore after a quality maximum has been exceeded. Excessive clearing is disadvantageous inasmuch as, during clearing, the vacuum in the vacuum cleaning device must be reduced, thereby causing a brief, unwanted interruption in the aspiration of dust. Clearing of the filter which is carried out too late or too infrequently is disadvantageous because this can give rise to periods in which the filter is already severely clogged, and therefore the suction power of the vacuum cleaning device may be impaired. As a result, filter efficiency may be reduced and more dust can get into the region of the turbine or blower. This in turn can lead to damage or impairment of the turbine and/or blower.

It is an object of the present invention to solve the problems described above and to provide a method for controlling a clearing process in a vacuum cleaning device by means of which filter clearing in accordance with requirements, with an efficiency check, is made possible and in which the control and initiation of a clearing process take place while taking into account the filter wear and/or filter aging.

The present invention provides a method for controlling a clearing process in a vacuum cleaning device, wherein the vacuum cleaning device comprises at least one filter, which is cleared regularly. The method is characterized by the following method steps:

a) specifying a first reference value, which defines a pressure range,
b) obtaining a differential pressure value which describes a current state of the filter,
c) determining whether the differential pressure value is in the pressure range defined in a),
d) determining a second reference value, either by retaining the first reference value or replacing the first reference value by the differential pressure value obtained in b), wherein the second reference value is specified in a manner dependent on whether the differential pressure value obtained in b) is in the pressure range defined in a).

By means of the proposed control method, effective and powerful filter clearing in accordance with requirements, which allows an efficiency check and, surprisingly, allows for filter wear and/or filter aging to be taken into account, can be provided. Taking into account filter wear and/or filter aging is made possible, in particular, by the adaptation of the reference value, which can be retained or changed depending on a current pressure value obtained in the vacuum cleaning device. One particular advantage of the invention is that filter clearing is controlled, i.e. initiated, in dependence on differential pressure. This advantageously makes it possible for the filter wear and/or filter aging to be taken into account in the control of filter clearing.

In the context of the present invention, a first reference value is first of all stipulated. This reference value preferably describes the state of the filter or of the filter elements forming the filter. According to the invention, it is particularly preferred that the first reference value describes a state of the filter or filter elements with respect to aging and/or wear. This state of the filters or filter elements can advantageously correspond to the quality of filter clearing, and it is therefore possible to derive information from the first reference value, preferably on the quality of filter clearing. The first reference value is preferably obtained before or as the vacuum cleaning device is put into operation, and it therefore preferably represents the state of the filter or filter elements at the start of the sucking mode of the vacuum cleaning device. According to the invention, there may also be a preference for the first reference value to be obtained after a previously stipulated operating time or after a certain number of clearing cycles has been performed, thus ensuring that the first reference value preferentially describes the state of the filter or filter elements after a short operating time of the vacuum cleaning device. According to the invention, there can also be a preference for the first reference value to be stipulated or checked by obtaining a differential pressure value or a flow resistance value and subtracting this differential pressure value or flow resistance value from a maximum differential pressure value or flow resistance value.

In a very particularly preferred embodiment of the invention, the reference value describes a state which is obtained when the vacuum cleaner is switched on and which is provided as a target value for further clearing operations. It is advantageously possible for this target value to be corrected up or down by using the method steps mentioned according to requirements and in dependence on the state of the filter, thus ensuring that, in particular, an adaptation of the target value for the filter clearing or filter clearing quality takes place in the context of the present invention.

In the context of the present invention, it is assumed that acceptable filter clearing is carried out at differential pressure values or flow resistance values above a minimum differential pressure value or flow resistance value that represents acceptable filter clearing. According to the invention, it is particularly preferred that the first reference value can be stipulated in accordance with operating parameters which can be obtained with reference to the vacuum cleaning device and the operation thereof. In other embodiments of the invention, the first reference value can also be specified as a theoretical value.

According to the invention, it is preferred that the first reference value is used as a starting point for the proposed method. The first reference value can preferably correspond to a pressure difference in the airflow or extraction volume flow, wherein the pressure difference is preferably measured in the airflow upstream and downstream of the filter. In other words, there is a preference according to the invention for a pressure in the air or extraction flow to be obtained at different points in the vacuum cleaning device, wherein a first measurement point can be in the airflow before the airflow passes through the filter, for example, and a second measurement point can be in the airflow downstream of the filter or after the airflow has passed through the filter. To put it another way, there is a preference according to the invention for a pressure difference to be obtained in the airflow upstream and downstream of the filter. Depending on filter contamination, the pressure difference will be greater or smaller, wherein low degrees of contamination are associated with a small pressure difference and severe contamination is associated with a large pressure difference.

If a small pressure difference is observed, this can indicate a low degree of contamination or clogging of the filter, indicating a good quality of the clearing process. If a high pressure difference is observed, a high degree of contamination or clogging of the filter can be inferred, indicating restricted clearing performance and reduced quality of the clearing process.

According to the invention, provision can also be made for the pressure values or pressure difference values obtained to be processed by means of information technology. Characteristic values, characteristic variables or comparison data can be calculated and/or derived from the pressure values or pressure difference values obtained, for example. In a very particularly preferred embodiment of the invention, the pressure values or pressure difference values obtained are used to calculate a flow resistance therefrom. In particular, it is possible for this purpose to obtain a $c_w$ value, which preferably describes the flow resistance which the filter has in the air or extraction flow. It has been found that the flow resistance value of the filter can be obtained particularly well on the basis of the pressure values or pressure difference values obtained. Moreover, the $c_w$ value of the filter has a particularly high technical information content in respect of the degree of contamination of the filter or the quality of filter clearing. According to the invention, there is a particular preference for the flow resistance value to be obtained using the motor characteristic of the vacuum cleaning device.

The pressure range which is placed around the first reference value in the context of the present invention can be stipulated in such a way, for example, that the first reference value is situated centrally or substantially centrally in the pressure range. There may also be a preference for the first reference value to represent an upper or lower limit of the pressure range and for the pressure range to be bounded in each case by a second threshold value. For example, the pressure range which is stipulated by the reference value can comprise a differential pressure value or flow resistance value which is regarded as adequate for qualitatively acceptable filter clearing. This differential pressure value or a flow resistance value can form a limit of the pressure range, for example.

According to a previously stipulated operating time or after a certain number of clearing cycles has been carried out, a differential pressure value that describes a current state of the filter can be obtained in the context of the present invention. This differential pressure is preferably the difference between the pressure conditions in the air or extraction flow upstream and downstream of the filter, which is obtained, in particular, by comparing pressure values which are obtained in the extraction flow upstream and downstream of the filter. According to the invention, the difference between the pressure conditions is preferably also referred to as the pressure difference. According to the invention, there is a very particular preference for a comparison between the original stipulated first reference value and the pressure difference value obtained to be carried out after a certain operating time or after a certain number of clearing processes has been performed. If the two values differ from a predefined threshold value, the pressure difference value obtained is used for comparison for subsequent clearing operations. By means of this comparison, the invention advantageously makes it possible to take into account the aging process or the clogging of the filter. According to the invention, there is a particular preference for the pressure difference value obtained to be compared with the first reference value. Thus, in a preferred embodiment, the proposed method comprises the following method step: comparison of the previously obtained differential pressure value with the first reference value.

It is then determined whether the differential pressure value is in the previously defined pressure range. Depending on whether the previously obtained differential pressure value is in the initially defined pressure range, a second reference value is stipulated, wherein the following distinction between cases is performed here. If the differential pressure value obtained is in the previously defined pressure range, the first reference value is retained. If the differential pressure value obtained is not in the previously defined pressure range, the first reference value is replaced by the currently obtained differential pressure value, and the second reference value is thereby obtained. This second reference value is preferably used as a starting point for the subsequent clearing process, and therefore the second reference value is preferably used as the "first reference value"

when the process is repeated. According to the invention, there may also be a preference for making the stipulation of the second reference value dependent on how the currently obtained differential pressure behaves relative to the first reference value. According to the invention, there is a particular preference for the differential pressure value to be obtained by forming the difference between pressure values which can be detected in an extraction flow of the vacuum cleaning device upstream and downstream of the filter.

According to the invention, the stipulation of the second reference value preferably corresponds to an adaptation of the reference value which is performed in order advantageously to achieve allowance for filter aging. If the first reference value is replaced in this adaptation by the pressure value obtained, and the pressure value obtained corresponds to a relatively severely aged filter, this relatively severe aging can be taken into account in performing or controlling the subsequent filter clearing process. In this exemplary embodiment, therefore, the proposed vacuum cleaning device will no longer try to achieve the original quality of filter clearing. Hitherto, this could lead to problems if an automatic filter clearing control system was constantly trying to achieve a filter clearing quality of the kind to be expected from an unused filter because this possibly leads to excessively frequent filter clearing processes being initiated. In the case of a vacuum cleaning device which, in accordance with the proposed control method, operates with an adaptation of the filter clearing quality to be achieved to the current state of the filter, the filter clearing processes are instead initiated in accordance with the current requirement and in accordance with the filter in respect of the aging and/or wear thereof. It is thereby advantageously possible to optimize the number of filter clearing processes per unit time, with the result that, on the one hand, the vacuum cleaning process does not have to be interrupted too frequently and, on the other hand, efficient suction performance of the vacuum cleaning device and efficient filtering of the airflow in the vacuum cleaning device are achieved.

According to the invention, it is preferred that the second reference value is greater than the first reference value. In other embodiments of the method, there may also be a preference for the second reference value to be less than the first reference value. This is the case especially if clearing which is above average in quality is detected. In other words, in the case of clearing which is above average in quality, it is also possible for the new, second reference value to be set below the original first reference value by means of a recalibration. This may be the case, for example, if the clearing operations performed have led to such good clearing results that the filter has a lower degree of contamination after clearing has been performed than when the vacuum cleaning device was started, for example. To this extent, there may be a preference, according to the invention, for the method steps to be performed not just once but to be carried out repeatedly.

The invention offers differential-pressure-dependent filter clearing in accordance with requirements, with an efficiency check, wherein the efficiency check is achieved, in particular, by comparing the currently obtained differential pressure value with the first reference value, and subsequently stipulating the second reference value in accordance with how the current differential pressure value behaves in relation to the first reference value. The second reference value can preferably correspond to the first reference value, or the first reference value can be replaced by the current differential pressure value, whereby a new or modified reference value is obtained, this preferably being referred to as the second reference value. The proposed method preferably comprises a reference value adaptation in order to take account of the aging process or the wear of the filter. In a preferred embodiment of the invention, the reference value can be recalibrated if the original, i.e. first, reference value, is undershot.

In a second aspect, the invention relates to a filter clearing operation for the vacuum cleaning device, which is controllable, i.e. can be controlled, by means of the proposed method. The vacuum cleaning device preferably comprises sensors for obtaining pressure values, wherein, in particular, the sensors are arranged in an extraction flow of the vacuum cleaning device upstream and downstream of the filter. It is thereby possible to determine the at least two pressure values, from which the differential pressure value can be formed by difference formation, that is to say, in particular, by carrying out a subtraction. Furthermore, the vacuum cleaning device preferably comprises a control device for initiating and carrying out the method steps of the control method.

Further advantages of the invention will become apparent from the following description of the figures. Various exemplary embodiments of the present invention are illustrated in the figure. The figure, the description and the claims contain numerous features in combination. A person skilled in the art will expediently also consider the features individually and combine them to form useful further combinations.

BRIEF DESCRIPTION OF THE DRAWINGS

In the figures, components which are the same and components of the same type are denoted by the same reference signs. In the figures.

DETAILED DESCRIPTION

Figure 1:
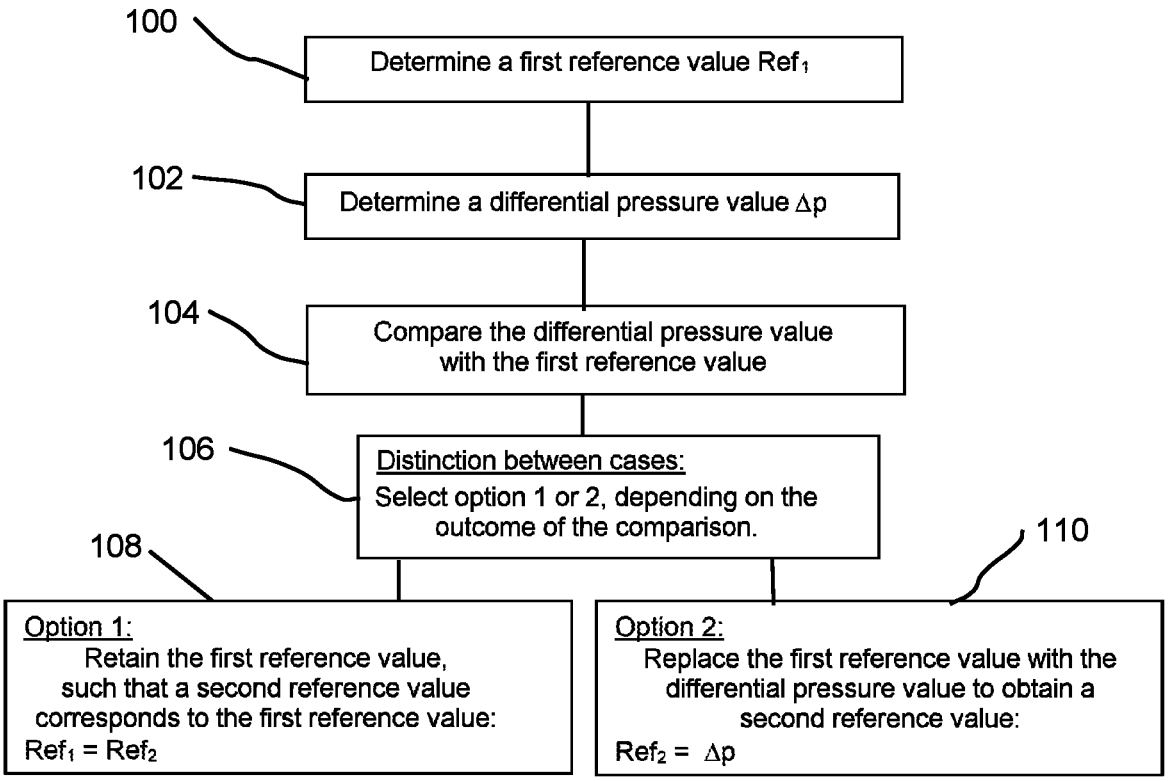
FIG. 1 shows a view of a preferred embodiment of the method.

FIG. 1 shows a preferred configuration of the method for controlling a clearing process in a vacuum cleaning device. In the method, which is illustrated schematically in a flow diagram in FIG. 1, differential-pressure-dependent filter clearing in accordance with requirements, during which the filter aging or filter wear is also taken into account, was achieved by virtue of the fact that a reference value, which preferably describes a state of the filter of the vacuum cleaning device, can be adapted over time to any filter aging or any filter wear. The reference value, which, according to the invention, is preferably also referred to as the first reference value, is preferably used as a control parameter for the proposed control method. It can provide information on a state of the filter of the vacuum cleaning device, and therefore the reference value preferably indicates what filter clearing quality should be attempted with the filter clearing operation. It is thereby possible, in the course of the operating time of a vacuum cleaning device, to take account of the fact that the filters of the vacuum cleaning device may become clogged due to operation, with the result that the vacuum cleaning device no longer tries to achieve the original filter clearing quality during subsequent clearing processes but tries to achieve a filter clearing quality adapted to the current state of the filter.

This is preferably achieved by virtue of the fact that the reference value can be adapted to a current state of the filter, wherein the current state of the filter is advantageously described by a differential pressure value, which is obtained in the extraction flow upstream and downstream of the filter.

As shown in FIG. 1, in a step 100, a first reference value $Ref_1$ is determined, and in step 102 a differential pressure value Δp related to the filter is determined. In step 104 Δp is compared with a pressure range defined by $Ref_1$ Depending on whether Δp is in the pressure range as indicated in step 106, the $Ref_1$ is retained (step 108) or replaced by Δp (step 110).

Figure 2:
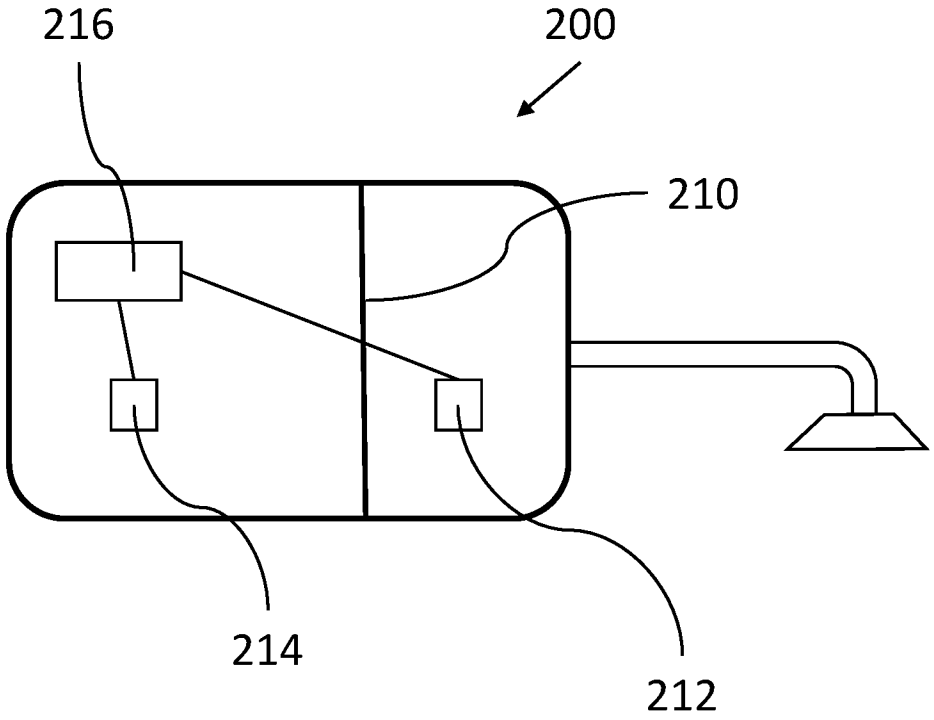
FIG. 2 shows schematically a vacuum cleaner of the present invention

FIG. 2 shows schematically a vacuum cleaner 200 for carrying out the method of the present invention and having a filter 210, sensors 212 and 214 and a controller 216.

What is claimed is:

1. A method for controlling a clearing process in a vacuum cleaning device, the vacuum cleaning device comprising at least one filter, the filter being cleared regularly, the method comprising:

stipulating a first reference value for at least one filter clearing process, the first reference value being used to define a defined pressure range, a first differential pressure value for qualitatively acceptable filter clearing being in the defined pressure range so that the defined pressure range includes the first differential pressure value;

operating the vacuum cleaning device and clearing the filter using the at least one filter clearing process with the first reference value as a target value for the clearing, and thereafter obtaining a current state differential pressure value describing a current state of the filter by forming a difference between pressure values detected in a flow of the vacuum cleaning device upstream and downstream of the filter;

determining whether the current state differential pressure value is in the defined pressure range; and when the current state differential pressure is within the defined pressure range, operating the vacuum cleaning device and keeping the first reference value for at least one subsequent filter clearing process with the first reference value as the target value; and when the current state differential pressure is outside the defined pressure range, operating the vacuum cleaning device and stipulating a second reference value for at least one further subsequent filter clearing process to account for filter aging and performing the at least one further subsequent filter clearing process using the second reference value as a second target value.

2. The method as recited in claim 1 wherein the second reference value is stipulated as the obtained pressure value and is greater than the first reference value.

3. The method as recited in claim 1 wherein the second reference value can be stipulated as the obtained differential pressure value and less than the first reference value when a filter clearing process results in a lower degree of contamination after a first filter clearing process.

4. The method as recited in claim 1 wherein the flow is an extraction flow of the vacuum cleaning device.

5. The method as recited in claim 1 wherein the first reference value is situated centrally in the defined pressure range.

6. The method as recited in claim 1 wherein the first reference value represents an upper limit of the defined pressure range.

7. The method as recited in claim 6 wherein a lower limit of the defined pressure range is bounded by a threshold value.

8. The method as recited in claim 1 wherein the first reference value represents a lower limit of the defined pressure range.

9. The method as recited in claim 8 wherein an upper limit of the pressure range is bounded by a threshold value.

10. A vacuum cleaning device comprising: a filter, and a controller configured to initiate and carry out a filter cleaning of the vacuum cleaning device by the method as recited in claim 1.

11. The vacuum cleaning device as recited in claim 10 further comprising sensors for obtaining pressure values, wherein the sensors are arranged in an extraction flow of the vacuum cleaning device upstream and downstream of the filter.

* * * * *